340-566 SR
XR 4,005,397

United States Patent [19]
Blair

[11] 4,005,397
[45] Jan. 25, 1977

EXTRA

[54] FENCE ALARM

[75] Inventor: Raymond Blair, Brentwood, N.Y.

[73] Assignee: International Fence Alarm Corporation, Sayville, N.Y.

[22] Filed: Sept. 2, 1975

[21] Appl. No.: 609,413

[52] U.S. Cl. ..... 340/223; 340/261; 256/1; 200/182

[51] Int. Cl.[2] ..... G08B 23/00

[58] Field of Search ..... 340/276, 325, 261, 309.1, 340/309.3, 309.4, 223; 256/1, 10; 200/182, 233

[56] References Cited

UNITED STATES PATENTS

| | | | |
|---|---|---|---|
| 2,345,771 | 4/1944 | Reynolds | 340/261 |
| 2,403,503 | 7/1946 | Coulter | 340/261 |
| 3,276,007 | 9/1966 | White | 340/261 |
| 3,745,552 | 7/1973 | Wilt | 340/261 |
| 3,763,482 | 10/1973 | Burney et al. | 340/261 X |
| 3,806,909 | 4/1974 | Bound | 340/261 |

*Primary Examiner*—John W. Caldwell
*Assistant Examiner*—William M. Wannisky
*Attorney, Agent, or Firm*—Bauer, Amer & King

[57] ABSTRACT

A sound or other such alarm which in practice is mounted on a fence so as to signal any attempt to surmount or bypass the fence, such attempt being an alarm condition; such alarm being characterized by its ability to distinguish said alarm condition from non-alarm conditions, thus having minimal false alarms, even though in all instances the alarm basically is triggered into operation in response to vibratory movement of the fence. This ability of the alarm to distinguish between alarm and non-alarm conditions is achieved by requiring a selected number of alarm-operating pulses (i. e. a selected number of vibrations in the fence) before the alarm operates.

4 Claims, 3 Drawing Figures

FENCE ALARM

The present invention relates generally to improvements for a fence alarm, the improvements being concerned not, as is characteristic of known alarms, with increasing the sensitivity level at which the alarm services or supervises contact made with the fence, but rather with enabling the alarm to operate with fewer false alarms.

It is already a well known security technique to enhance the protection afforded by a fence by equipping the fence with an alarm capable of indicating when contact is established therewith. This technique is exemplified by prior U.S. Pat. No. 2,345,771 and No. 2,403,503, which patents characteristically emphasize the need to use a highly sensitive alarm so that the slightest contact with the fence is signalled or indicated by the alarm. In situations where the alarm provides a visual signal, a highly sensitive operating level in the alarm is perhaps no drawback, except for the obvious high cost of providing supervising personnel to monitor the visual signal and to check out the situation each time it operates. Where the alarm is a sound signal, each false alarm can be very disruptive to those in the surrounding area.

Broadly, it is an object of the present invention to provide an improved fence alarm overcoming the foregoing and other shortcomings of the prior art. Specifically, it is an object to embody the alarm with a selectively variable sensitivity level and to advantageously utilize the same to contribute to the effectiveness of the alarm to distinguish between what should be an alarm-sounding condition and what should not.

An alarm for detecting the surmounting of a fence or other vertical barrier demonstrating objects and advantages of the present invention includes plural pulse-emitting switches strategically located in supported relation along the fence so as to cause the transmission of an electrical pulse in response to a vibratory movement of the fence. Also included are a stepping switch electrically connected to be operated by the transmitted pulses so as to be urged through movement from a starting contact into contact with succesively encountered contacts, a timer electrically connected to cause the positioning of the stepping switch at its starting contact at each conclusion of a successive timing interval of operation of the timer, an alarm electrically connected to be selectively operated by said transmitted pulses, and a rotary switch having cooperating contacts in the same relation with it as the successively encountered contacts are related to the stepping switch. The rotary switch is electrically connected in a circuit-completing interposed position between the stepping switch and the alarm and, as a consequence, the circuit therebetween is completed only when the stepping switch and the rotary switch are each at cooperating corresponding circuit-completing contacts. Thus, an imposed condition for operation of the alarm is, of course, the completion of the circuit as provided by the selection of a rotary switch contact, but within the timing interval of the timer. In practice it has been found that this condition contributes to minimal false alarms.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
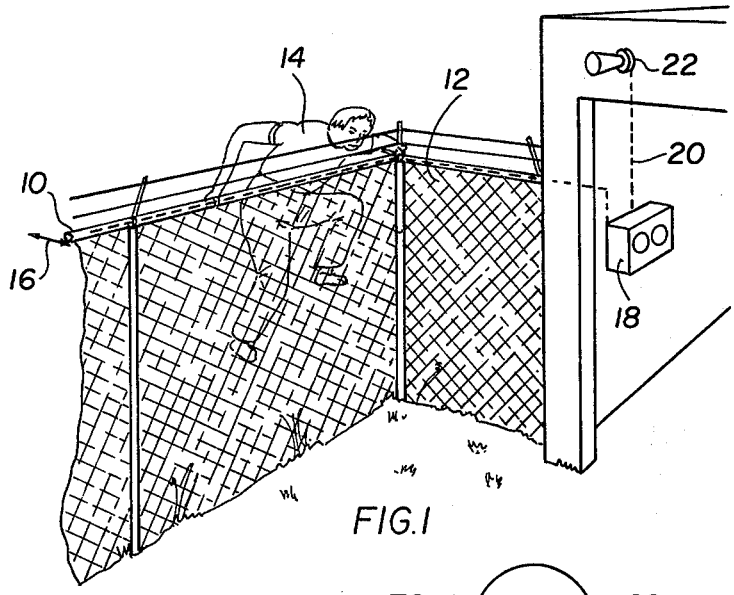
FIG. 1 is a perspective view illustrating a typical intrusion which in practice is detected by the fence alarm hereof.

The environment for use of the within alarm is illustrated in FIG. 1. Specifically, the alarm, or at least the sensing switches thereof, will typically be installed within a top cylindrical member 10 of a conventional fence 12. As a consequence, and as will be described in detail subsequently, when an intruder 14 attempts to surmount or climb over the fence 12, this activity will necessarily produce vibratory motion 16 in the fence 12. Motion 16, in turn, will result in the transmission of electrical pulses to the operating components of the within alarm, which conveniently will be located in a housing 18.

When an alarm condition exists, as will be explained subsequently, control 18 electrically connected by a conductor 20 to an alarm, which may be a horn 22 or similar signalling device, will result in the operation thereof, and thus the production of an audible signal indicating that an intruder 14 is attempting to penetrate the fence 12.

Although fence alarms operating generally in the manner just described are already well known, the improved alarm now to be described in detail can be readily distinguished from these known alarms by its unique ability to distinguish between a condition in which an intruder 14 is attempting to surmount the fence 12, which will be understood to be a serious and thus an alarm condition, from other conditions which may also produce vibratory motion 16 in the fence 12 but which are caused by less serious, and almost inconsequential circumstances. For example, a temporary breeze or the temporary brushing against the fence 12 by a dog or passerby will produce some vibratory motion 16, but obviously it is not desirable that these conditions result in the sounding of the alarm 22. In fact, the sounding of the alarm 22 under these conditions would be a false alarm from the viewpoint that it does not accurately indicate that an attempt is being made to surmount fence 12 and thus gain access to the premises despite the fence 12.

An important contribution of the present invention is the recognition that the vertical height of the fence 12 can be advantageously used to enable the fence alarm hereof to differentiate between different circumstances which may result in vibratory motion 16 thereof. Specifically, in a typical security situation, fence 12 would be approximately 6 feet high. Thus to surmount the fence 12 it is necessary for the intruder 14 to climb up one side of the fence 12, over the top member 10 thereof, and then down the other side. Unavoidably, therefore, the intruder 14 is in contact with the fence 12 for the period of time that it will take to achieve climbing up and over the fence. It has been determined that this interval of climbing activity, and more important the vibratory motion 16 resulting therefrom, typically exceeds the vibratory motion 16 that is produced by non-alarm circumstances, such as is produced, for example, by the wind or by a casual contact with the fence 12 by an animal or passerby.

Figure 2:
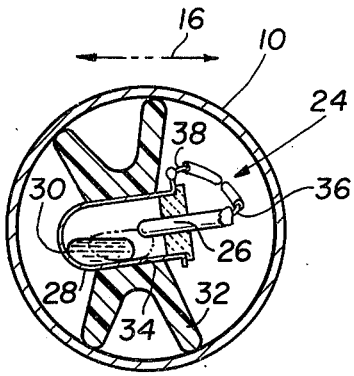
FIG. 2 is a side elevational view, on an enlarged scale, illustrating an acceptable sensing switch used for the fence alarm hereof, in which the positions of movement of a body of mercury of the switch are illustrated in full line and phantom line perspective.
Figure 3:
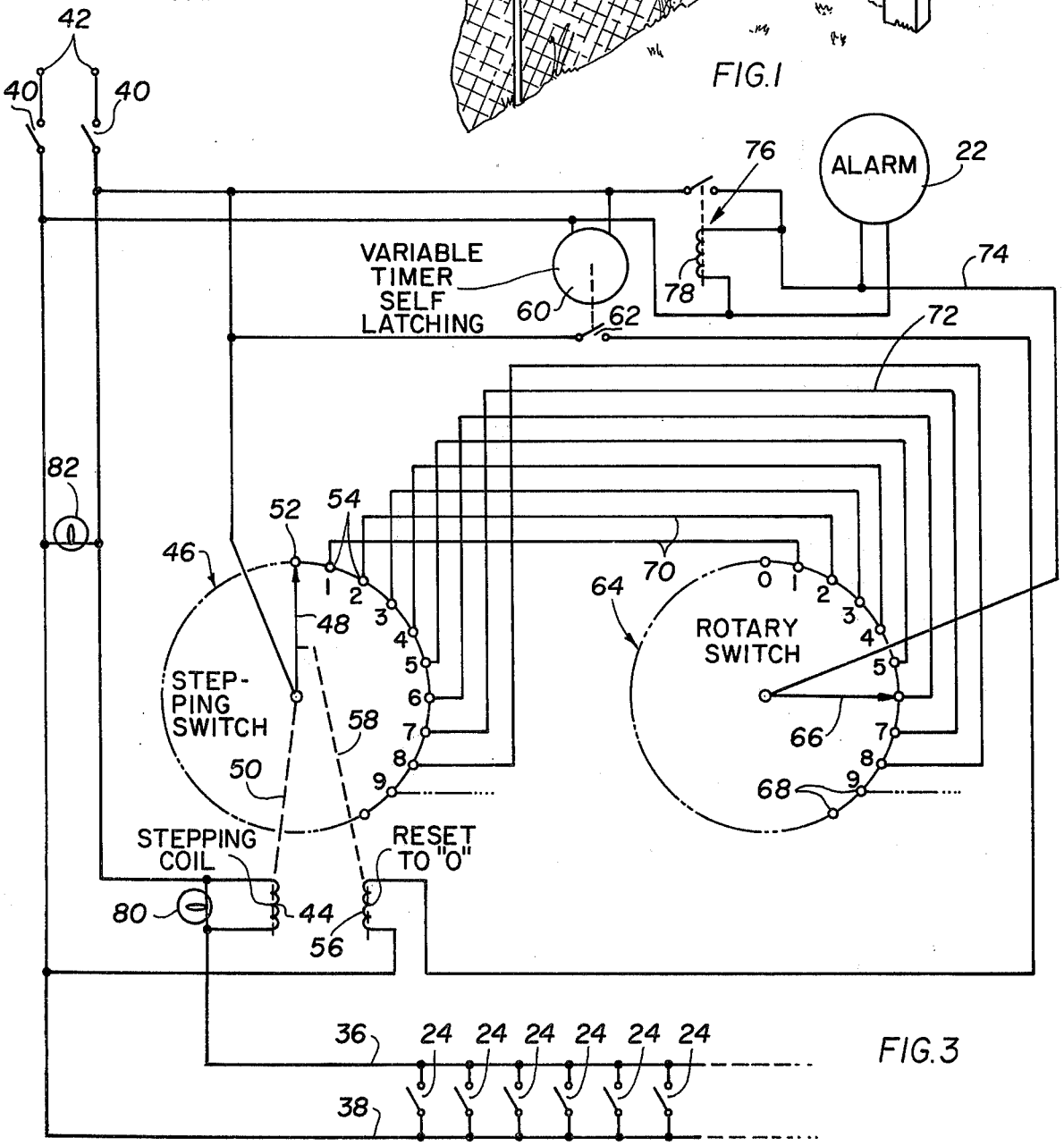
FIG. 3 is a circuit diagram illustrating the cooperative relationship of the electrical components of the within alarm.

Before describing how a threshold of vibratory movement 16 is selected before alarm 22 is sounded, and conversely how less than the threshold does not produce operation of the alarm 22, all of which description will be provided primarily in conjunction with FIG. 3, it is helpful first to refer to FIG. 2 which illustrates a typical sensing switch, generally designated 24, which is advantageously used as part of the operating system for the alarm 22. Switch 24 may be any one of several available switches of the normally open type which is closed in response to vibratory motion 16. One such model found to be effective in practice is a mercury switch supplied by Dura Cool Inc. of Elkhart, Indiana. This switch includes two electrical contacts 26 and 28 which are electrically closed, i.e. an electric circuit is completed between these two contacts, when a body or volume of mercury 30 moves into simultaneous contact with these two contacts, as illustrated in phantom perspective in FIG. 2. Thus, the normal position of the switch 24 is one in which it is mounted internally of the cylindrical member 10 at a critical angle at which the mercury 30 contacts only contact 28 but not contact 26, the mercury 30 occupying the position illustrated in full line in FIG. 2. This critical angular orientation of the switch 24 is readily provided by a member 32 disposed internally of the cylindrical member 10 and having a through bore 34 therein at the appropriate angle so that when switch 24 is inserted therein mercury 30 occupies the full line position illustrated. However, in response to vibratory movement 16, mercury 30 will move back and forth between its full line and phantom line positions illustrated in FIG. 2, and it will be understood that each time the mercury 30 simultaneously contacts both the contacts 26 and 28 that it results in the pulse-transmitting operation of switch 24. This operation, as is well understood, results in the transmission of an electrical pulse through the switch 24.

Referring now to FIG. 3, it will be explained how each pulse transmitted by a sensing switch 24 assists in establishing when an alarm-sounding condition exists and alarm 22 should therefore be operated, and conversely when a non-alarm condition exists even though there is vibratory motion 16 in the fence 12. As clearly illustrated in the circuit diagram of FIG. 3, a plurality of normally open switches 24 will be understood to be electrically connected in parallel across conductors 36 and 38 which in turn are connected via main circuit on-off switches 40 to a low voltage source 42. In actual practice, each of the switches 24 are preferably located every ten feet along the upper cylindrical member 10, but the spacing may be more or less depending on the flexibility of the fence 12 and thus its propensity to be actuated through vibratory motion 16 under the weight of an intruder 14 climbing over the fence. Connected in series with these switches 24, and more particularly in series connection in the conductor 36 is a stepping coil 44 of a stepping switch generally designated 46. The operation of stepping switches should be readily well understood and any one of several commercially available models thereof can be utilized for the fence alarm 22 hereof. In practice, the commercial embodiment found effective is that provided by MER Guardian Electric, of Chicago, Illinois. As is well understood, stepping switch 46 includes a movable switch arm 48 which is appropriately mechanically and electrically arranged, by well understood mechanisms generally designated 50, to be actuated through clockwise movement from a starting contact 52 through successively encountered contacts, individually and collectively designated 54 (and also numbered consecutively 1 through 9). Such movement of arm 48 occurs each time that an electrical pulse caused by the closing of one of the switches 24 is transmitted through the stepping coil 44.

Completing the construction of the stepping switch 46, insofar at least as it is necessary for an understanding of the present invention, is a reset coil 56 operatively effective by virtue of well understood mechanisms 58, to reset, each time that coil 56 is electrically pulsed, the movable switch arm 48 back to the starting contact 52 irrespective of the successively encountered contact 54 it is located at, at the time that coil 56 is pulsed. The manner in which coil 56 is pulsed will soon be described, it being sufficient at this time to understand that pulsing thereof does occur periodically and that the function thereof is to clear stepping switch 46, or more particularly to return the arm 48 thereof back to the starting contact 52.

The aforesaid clearing of the stepping switch 46 is one of the significant operating parameters of the within alarm which assists it in distinguishing between alarm and non-alarm conditions. Specifically, let it be assumed that for an alarm condition it will be necessary for the switch arm 48 to move from the starting contact 52 to the contact 54 specifically identified by the number 6. In effect, this means that the alarm 22 will not be sounded until at least six pulses are transmitted to the stepping coil 44 resulting, in turn, in movement of the arm 48 to the contact 6. With the particular fence 12 involved, this should be assumed to be the condition that the user has empirically determined will constitute the number of vibrations 16 that will be produced by an intruder 14 attempting to surmount the fence 12. On the other hand, a casual contact made with the fence 12 will result also in vibratory motion 16, although it may only result in two or three pulses being transmitted to the coil 44. This of course will not result in operation of the alarm 22. However, if following one casual or non-alarm contact with the fence 12 another such contact occurs, the accumulation of an additional three pulses will result in switch arm 48 reaching position 6 of the stepping switch 46. There thus will be a false alarm if alarm 22 is permitted to be operated. It is thus an important contribution of the present invention to cause a pulsing of the reset coil 56 on a periodic basis, thus clearing the stepping switch 46 or, as already indicated, relocating the switch arm 48 back at its original starting contact 52. This avoids an accumulation of pulses being transmitted to the stepping coil 44 in successively occurring non-alarm conditions resulting in a false alarm sounding of the alarm 22.

Controlling the reset coil 56 is a variable timer 60 which is appropriately electrically connected, as illustrated in FIG. 3, so that at the conclusion of a selected interval of time it will produce a closing of a cooperating switch 62 which, in turn, will result in a pulse being transmitted to the reset coil 56, and thus a resetting of switch arm 48 back to its position adjacent the starting contact 52. Any interval of timing operation of timer 60 can be selected, at the conclusion of which switch 62 is temporarily closed resulting in the pulsing of the reset coil 56. In practice, successive intervals of operation of 2 minutes have been found effective to eliminate false alarms that otherwise would be produced by successive occurrences of non-alarm conditions.

Electrically connected in cooperating relation with the stepping switch 46 so as to permit the selection of one of the contacts 54 as the one effective to produce operation of the alarm 22 is a conventional rotary switch 64. Switch 64 will be understood to be similar to the stepping switch 46 except that it does not include a stepping coil for pulsing its movable switch arm 66. Instead, switch arm 66 is manually movable so that it can be set at any one of the successively encountered contacts, individually and collectively designated 68, which contacts are also further identified in FIG. 3 with the numerals 1 through 9. As clearly illustrated in FIG. 3, the contacts 68 of the rotary switch 64 bear the same relationship to the switch arm 66 thereof that the contacts 54 bear to the switch arm 48 of the stepping switch 46.

The cooperative relationship between the stepping switch 46 and rotary switch 64 is established by conductors connected therebetween, individually and collectively designated 70. As clearly illustrated in FIG. 3 the same numbered contacts 54 and 68 are electrically connected by a conductor 70. Thus, continuing with the previous example, contact 6 is connected via that conductor, specifically designated 72 in FIG. 3, to its counterpart corresponding contact which would be the sixth encountered contact of rotary switch 64. As a result, when contact arm 48 of stepping switch 46 establishes electrical contact with contact 6, the circuit is complete via conductor 72 and via contact arm 66 and conductor 74 electrically connected to voltage source 42 to an alarm-operating switch 76. When switch 76 closes, this in turn connects the alarm 22 to the voltage source 42 and thus results in operation of the alarm 22. Since switch 76 includes a holding coil 78, alarm 22 will continue to operate, i.e. produce a sound, until switch 76 or the circuit switch 40 is manually opened.

Completing the control circuit of FIG. 3 are pilot lights 80 and 82 appropriately electrically connected, as clearly illustrated in FIG. 3, to indicate when energized that the circuit is operational. In this specific connection, the provision of pilot light 80 in supervising relation to the stepping coil 44 is one of the noteworthy aspects of the within alarm. In prior art fence alarms, the alarm either operates or it does not. In the within alarm, however, even a non-alarm condition, i.e. less than the specified number of pulsed movements of arm 48, produces energizing of the light 80 and thus indicates that the circuitry of the alarm is operational even though alarm 22 may not have sounded for a prolonged period of use.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An alarm for detecting the surmounting of a fence or other vertical barrier, said alarm comprising plural pulse-emitting switches strategically located in supported relation along said fence so as to cause the transmission of an electrical pulse in response to a vibratory movement of said fence, a stepping switch having circumferentially spaced plural contacts including a starting contact and successively encountered vibration-detecting contacts electrically connected to be operated by said transmitted pulses so as to be urged through movement from said starting contact into contact with said successively encountered vibration-detecting contacts, said stepping switch also having an electrically operated reset coil for being returned to said starting contact from a position at any one successively encountered vibration-detecting contact in response to an electrical pulse transmitted to said reset coil, a timer electrically connected to pulse said reset coil to cause the positioning of said stepping switch at said starting contact at each conclusion of a successive timing interval of operation of said timer, an alarm electrically connected to be selectively operated by said transmitted pulses, and a rotary switch having cooperating contacts in substantial relation therewith as said successively encountered contacts are related to said stepping switch, said rotary switch being electrically connected in circuit-completing interposed position between said stepping switch and said alarm so that said circuit therebetween is completed only when said stepping switch and said rotary switch are each at cooperating corresponding circuit-completing contacts, whereby an imposed condition for operation of said alarm is the completion of said circuit as provided by the selection of a rotary switch contact within said timing interval of said timer, and thus a condition contributing to minimal false alarms.

2. A fence alarm as defined in claim 1 wherein said pulse-emitting switches are normally open switches connected in parallel across an electrical source electrically connected to operate said stepping switch, each said pulse-emitting switch being actuated into a closed condition by said vibratory movement of said fence so as to cause in said closed condition the transmission from said electrical source of an electrical pulse operating said stepping switch.

3. A fence alarm as defined in claim 2 including a visual signal device connected in supervising relation to said stepping switch, whereby said visual signal is effective in indicting electrical continuity of said alarm even upon operation of said stepping switch not resulting in the operation of said alarm.

4. A fence alarm as defined in claim 3 wherein said pulse-emitting switches are mercury switches, each containing a volume of mercury movable between positions closing and opening electrical contacts of said switch.

* * * * *